US006190176B1

(12) United States Patent
Turner

(10) Patent No.: US 6,190,176 B1
(45) Date of Patent: Feb. 20, 2001

(54) PORTABLE DUAL BATTER TRAINER

(76) Inventor: Hilton L. Turner, 16640 A Prine Rd., Citronelle, AL (US) 36522

( * ) Notice: Under 35 U.S.C. 154(b), the term of this patent shall be extended for 0 days.

(21) Appl. No.: 09/465,673

(22) Filed: Dec. 17, 1999

(51) Int. Cl.[7] ..... A63B 69/04
(52) U.S. Cl. ..... 434/247; 473/429; 473/430
(58) Field of Search ..... 434/247; 473/429, 473/430, 424, 393, 417, 419

(56) References Cited

U.S. PATENT DOCUMENTS 3,166,317 * 1/1965 Tumelson ..... 473/430
4,521,016 * 6/1985 Tominaga ..... 473/430
4,664,375 * 5/1987 Tetreault ..... 473/429
4,674,744 * 6/1987 Walsh ..... 473/430
5,071,122 * 12/1991 Messina ..... 473/429
5,303,914 * 4/1994 Cooksey ..... 473/429
5,427,369 * 6/1995 Baquet ..... 473/429
5,586,942 * 12/1996 Wittek ..... 473/168
5,603,669 * 2/1997 Scott ..... 473/405
5,842,938 * 12/1998 Garber ..... 473/430

* cited by examiner

*Primary Examiner*—Jacob K. Ackun
*Assistant Examiner*—Kurt Fernstrom
(74) *Attorney, Agent, or Firm*—Joseph N. Breaux

(57) ABSTRACT

A portable dual batter trainer device that includes a collapsible support stand; a trainer top plate assembly secured to the collapsible support stand; and two tethered batting balls suspended from the trainer top plate assembly. In a preferred embodiment the portable dual batter trainer device also includes a removable fabric safety divider securable to the collapsible support stand between the two tethered batting balls.

2 Claims, 4 Drawing Sheets

PORTABLE DUAL BATTER TRAINER

TECHNICAL FIELD

The present invention relates to athletic training equipment and more particularly to a portable dual batter trainer that includes a collapsible support stand, a trainer top plate assembly secured to the collapsible support stand, two tethered batting balls suspended from the trainer top plate assembly, and a removable fabric safety divider securable to the collapsible support stand between the two tethered batting balls; the collapsible support stand including an upper horizontal support assembly, two telescoping, pivoting leg assemblies and a bottom cross brace; each of the two telescoping pivoting leg assemblies including a foot portion including a floor contact tube with two spaced foot tubes extending perpendicularly from the floor contact tube and in parallel with each other and a top pivoting portion having a cross brace receiving tube secured between two foot tube receiving tubes; the two foot tube receiving tubes each having a first receiving tube end pivotally connected to the upper horizontal support assembly and a second pivoting tube end adapted to slidingly receiving one of the two foot tubes; the two foot tubes being adjustably securable in fixed relation to the two foot tube receiving tubes with a height adjustment securing bolt so as to support the trainer top plate assembly at the desired height in use; the bottom cross brace having two brace ends wherein each brace end is insertable into and securable within one of the cross brace receiving tubes by a bolt and nut assembly; the upper horizontal support assembly having three, spaced, parallel oriented, horizontal support tubes; two telescoping, pivoting leg assemblies each pivotally connected to opposite ends of the three spaced parallel oriented, horizontal support tubes of the upper horizontal support assembly and pivotal into an open position oriented perpendicular to the three spaced, parallel oriented, horizontal support tubes and into a closed position folded against the three spaced, parallel oriented, horizontal support tubes; the bottom cross brace being connectable between the two telescoping, pivoting leg assemblies when the two telescoping, pivoting leg assemblies are both positioned in the open position; the two brace ends of the bottom cross brace being each securable to a respective one of the two telescoping, pivoting leg assemblies to maintain the two telescoping, pivoting leg assemblies in the open position; one of the three, spaced, parallel oriented, horizontal support tubes of the upper horizontal support assembly and the bottom cross brace each being provided with tube fastening hook and pile fasteners along a side thereof; the removable fabric safety divider including divider hook and pile fasteners that are companionately attachable to the tube fastening hook and pile fasteners to detachably secure the removable fabric safety divider to the collapsible support stand.

BACKGROUND ART

It is often desirable to use training aids when training athletes. Although training aids are beneficial in some instances, they are often bulky and difficult to transport to training locations such as little league ball fields. It would be desirable, therefore, to have a portable batter trainer that could be easily transported and set up at a training location and just as easily collapsed and transported to a storage location. Because it is often necessary for a trainer to supervise more than one athlete at a time, it would be a further benefit to have a portable batter trainer that included two tethered baseballs to allow two athletes to use the batter trainer at the same time.

GENERAL SUMMARY DISCUSSION OF INVENTION

It is thus an object of the invention to provide a portable dual batter trainer that includes a collapsible support stand, a trainer top plate assembly secured to the collapsible support stand, two tethered batting balls suspended from the trainer top plate assembly, and a removable fabric safety divider securable to the collapsible support stand between the two tethered batting balls; the collapsible support stand including an upper horizontal support assembly, two telescoping, pivoting leg assemblies and a bottom cross brace; each of the two telescoping pivoting leg assemblies including a foot portion including a floor contact tube with two spaced foot tubes extending perpendicularly from the floor contact tube and in parallel with each other and a top pivoting portion having a cross brace receiving tube secured between two foot tube receiving tubes; the two foot tube receiving tubes each having a first receiving tube end pivotally connected to the upper horizontal support assembly and a second pivoting tube end adapted to slidingly receiving one of the two foot tubes; the two foot tubes being adjustably securable in fixed relation to the two foot tube receiving tubes with a height adjustment securing bolt so as to support the trainer top plate assembly at the desired height in use; the bottom cross brace having two brace ends wherein each brace end is insertable into and securable within one of the cross brace receiving tubes by a bolt and nut assembly; the upper horizontal support assembly having three, spaced, parallel oriented, horizontal support tubes; two telescoping, pivoting leg assemblies each pivotally connected to opposite ends of the three spaced parallel oriented, horizontal support tubes of the upper horizontal support assembly and pivotal into an open position oriented perpendicular to the three spaced, parallel oriented, horizontal support tubes and into a closed position folded against the three spaced, parallel oriented, horizontal support tubes; the bottom cross brace being connectable between the two telescoping, pivoting leg assemblies when the two telescoping, pivoting leg assemblies are both positioned in the open position; the two brace ends of the bottom cross brace being each securable to a respective one of the two telescoping, pivoting leg assemblies to maintain the two telescoping, pivoting leg assemblies in the open position; one of the three, spaced, parallel oriented, horizontal support tubes of the upper horizontal support assembly and the bottom cross brace each being provided with tube fastening hook and pile fasteners along a side thereof; the removable fabric safety divider including divider hook and pile fasteners that are companionately attachable to the tube fastening hook and pile fasteners to detachably secure the removable fabric safety divider to the collapsible support stand.

Accordingly, a portable dual batter trainer is provided. The portable dual batter trainer includes a collapsible support stand, a trainer top plate assembly secured to the collapsible support stand, two tethered batting balls suspended from the trainer top late assembly, and a removable fabric safety divider securable to the collapsible support stand between the two tethered batting balls; the collapsible support stand including an upper horizontal support assembly, two telescoping, pivoting leg assemblies and a bottom cross brace; each of the two telescoping pivoting leg assemblies including a foot portion including a floor contact tube with two spaced foot tubes extending perpendicularly from the floor contact tube and in parallel with each other and a top pivoting portion having a cross brace receiving tube secured between two foot tube receiving tubes; the two foot tube receiving tubes each having a first receiving tube end pivotally connected to the upper horizontal support assembly and a second pivoting tube end adapted to slidingly receiving one of the two foot tubes; the two foot tubes being adjustably securable in fixed relation to the two foot tube receiving tubes with a height adjustment securing bolt so as to support the trainer top plate assembly at the desired height in use; the bottom cross brace having two brace ends wherein each brace end is insertable into and securable within one of the cross brace receiving tubes by a bolt and nut assembly; the upper horizontal support assembly having three, spaced, parallel oriented, horizontal support tubes; two telescoping, pivoting leg assemblies each pivotally connected to opposite ends of the three spaced parallel oriented, horizontal support tubes of the upper horizontal support assembly and pivotal into an open position oriented perpendicular to the three spaced, parallel oriented, horizontal support tubes and into a closed position folded against the three spaced, parallel oriented, horizontal support tubes; the bottom cross brace being connectable between the two telescoping, pivoting leg assemblies when the two telescoping, pivoting leg assemblies are both positioned in the open position; the two brace ends of the bottom cross brace being each securable to a respective one of the two telescoping, pivoting leg assemblies to maintain the two telescoping, pivoting leg assemblies in the open position; one of the three, spaced, parallel oriented, horizontal support tubes of the upper horizontal support assembly and the bottom cross brace each being provided with tube fastening hook and pile fasteners along a side thereof; the removable fabric safety divider including divider hook and pile fasteners that are companionately attachable to the tube fastening hook and pile fasteners to detachably secure the removable fabric safety divider to the collapsible support stand.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
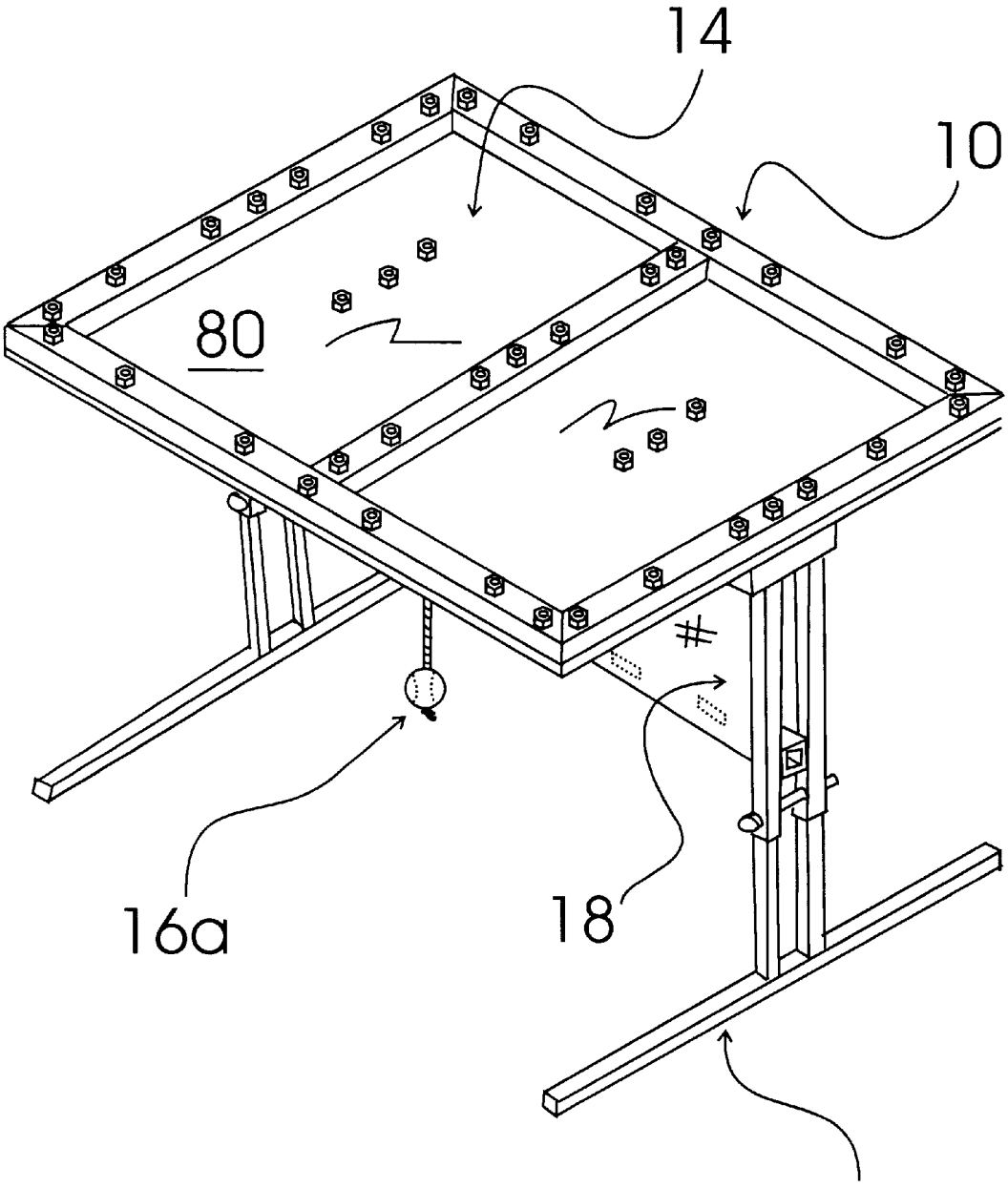
FIG. 1 is a perspective view of an exemplary embodiment of the portable dual batter trainer of the present invention showing the collapsible support stand, the trainer top plate assembly secured to the collapsible support stand, one of the two tethered batting balls suspended from the trainer top plate assembly, and the removable fabric safety divider securable to the collapsible support stand between the two tethered batting balls.
Figure 2:
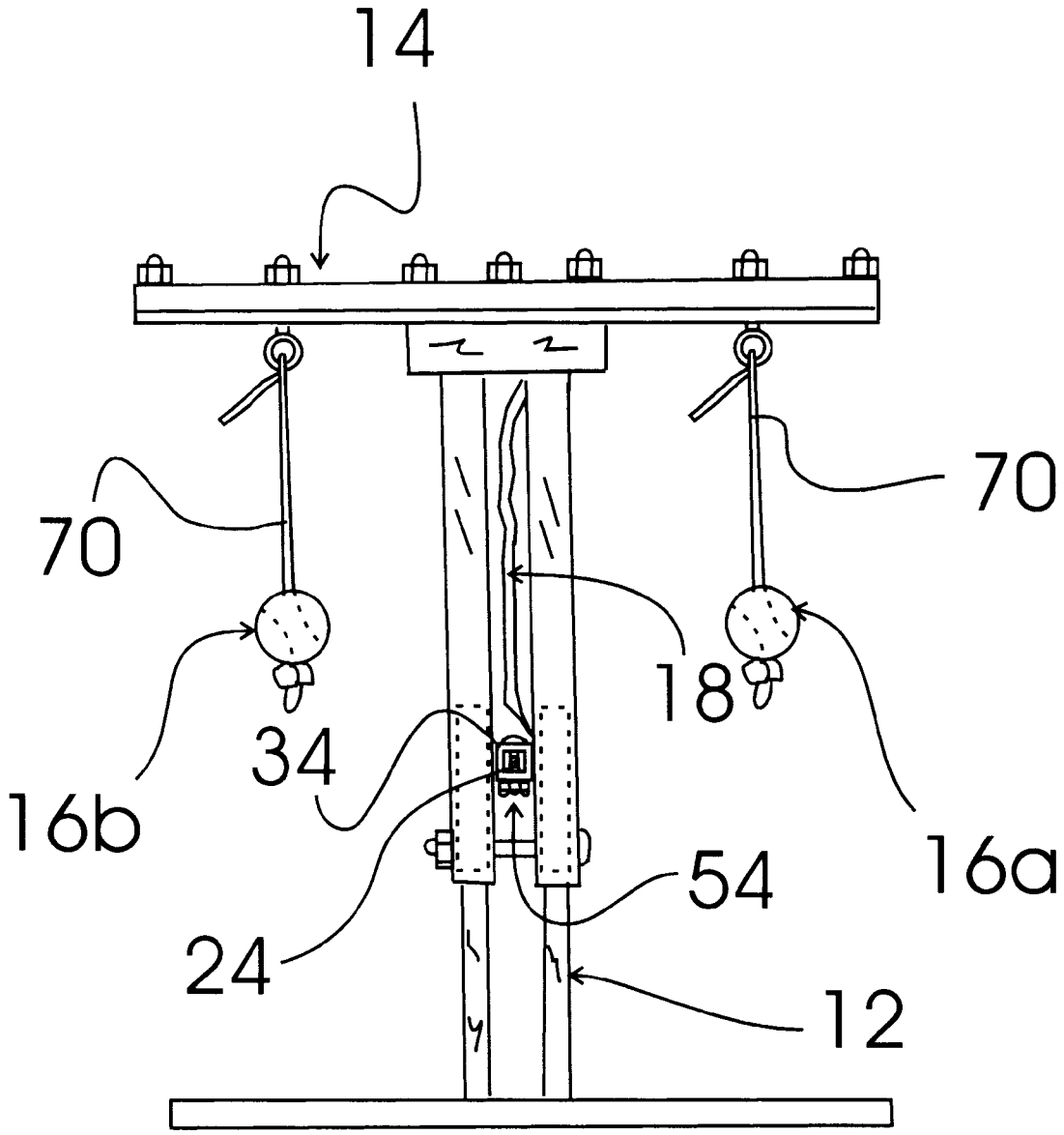
FIG. 2 is an end plan view of the portable dual batter trainer of FIG. 1 showing the trainer top plate assembly secured to the collapsible support stand; the collapsible support stand including an upper horizontal support assembly, two telescoping, pivoting leg assemblies and a bottom cross brace; each of the two telescoping pivoting leg assemblies including a foot portion including a floor contact tube with two spaced foot tubes extending perpendicularly from the floor contact tube and in parallel with each other and a top pivoting portion having a cross brace receiving tube secured between two foot tube receiving tubes; the two foot tube receiving tubes each having a first receiving tube end pivotally connected to the upper horizontal support assembly and a second pivoting tube end adapted to slidingly receiving one of the two foot tubes; the two foot tubes being adjustably securable in fixed relation to the two foot tube receiving tubes with a height adjustment securing bolt so as to support the trainer top plate assembly at the desired height in use; the bottom cross brace having two brace ends wherein each brace end is insertable into into and securable within one of the cross brace receiving tubes by a bolt and nut assembly; the two tethered batting balls suspended from the trainer top plate assembly, and the removable fabric safety divider securable to the collapsible support stand between the two tethered batting balls.

FIG. 1 shows an exemplary embodiment of the portable dual batter trainer of the present invention, generally designated 10. Portable dual batter trainer 10 includes a collapsible support stand, generally designated 12; a trainer top plate assembly, generally designated 14, secured to collapsible support stand 12; two tethered batting balls 16*a*,16*b*, referring also now to FIG. 2, suspended from trainer top plate assembly 14; and a removable fabric safety divider, generally designated 18, securable to collapsible support stand 12 between tethered batting balls 16*a*,16*b*.

Figure 3:
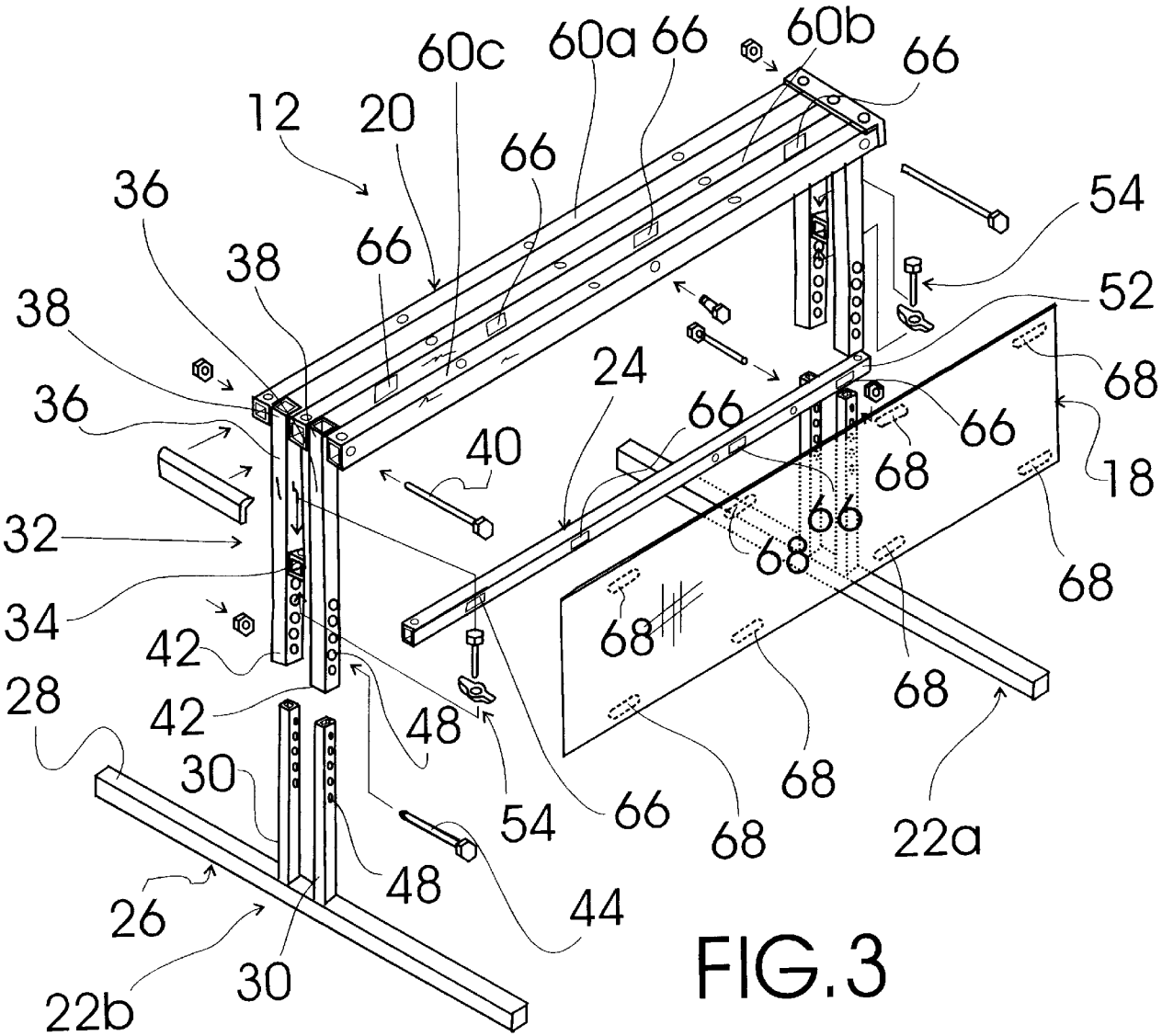
FIG. 3 is a partially exploded, perspective view of the collapsible support stand and the removable fabric safety divider in isolation; the collapsible support stand including the upper horizontal support assembly having three, spaced, parallel oriented, horizontal support tubes; two telescoping, pivoting leg assemblies each pivotally connected to opposite ends of the three spaced parallel oriented, horizontal support tubes of the upper horizontal support assembly and pivotal into an open position oriented perpendicular to the three spaced, parallel oriented, horizontal support tubes and into a closed position folded against the three spaced, parallel oriented, horizontal support tubes; and the bottom cross brace; the bottom cross brace being connectable between the two telescoping, pivoting leg assemblies when the two telescoping, pivoting leg assemblies are both positioned in the open position; the two brace ends of the bottom cross brace being each securable to a respective one of the two telescoping, pivoting leg assemblies to maintain the two telescoping, pivoting leg assemblies in the open position; one of the three, spaced, parallel oriented, horizontal support tubes of the upper horizontal support assembly and the bottom cross brace each being provided with tube fastening hook and pile fasteners along a side thereof; the removable fabric safety divider including divider hook and pile fasteners that are companionately attachable to the tube fastening hook and pile fasteners to detachably secure the removable fabric safety divider to the collapsible support stand.

Referring now also to FIG. 3, collapsible support stand 12 includes an upper horizontal support assembly, generally designated 20; two telescoping, pivoting leg assemblies, generally designated respectively 22*a*,22*b*; and a bottom cross brace, generally designated 24. Each of the telescoping pivoting leg assemblies 22*a*,22*b* includes a foot portion, generally designated 26, including a floor contact tube 28 with two spaced foot tubes 30 extending perpendicularly from floor contact tube 28 and in parallel with each other and a top pivoting portion, generally designated 32, having a cross brace receiving tube 34 secured between two foot tube receiving tubes 36. Foot tube receiving tubes 36 each have a first receiving tube end 38 pivotally connected to upper horizontal support assembly 20 with a securing pin 40 and a second pivoting tube end 42 adapted to slidingly receiving one of the two foot tubes 30. The foot tubes 30 are adjustably securable in fixed relation to the two foot tube receiving tubes 36 with a height adjustment securing bolt 44 that si positionable through alignable apertures 48 of foot tubes 30 and foot tube receiving tubes 36 so as to support trainer top plate assembly 14 at desired height in use.

Figure 4:
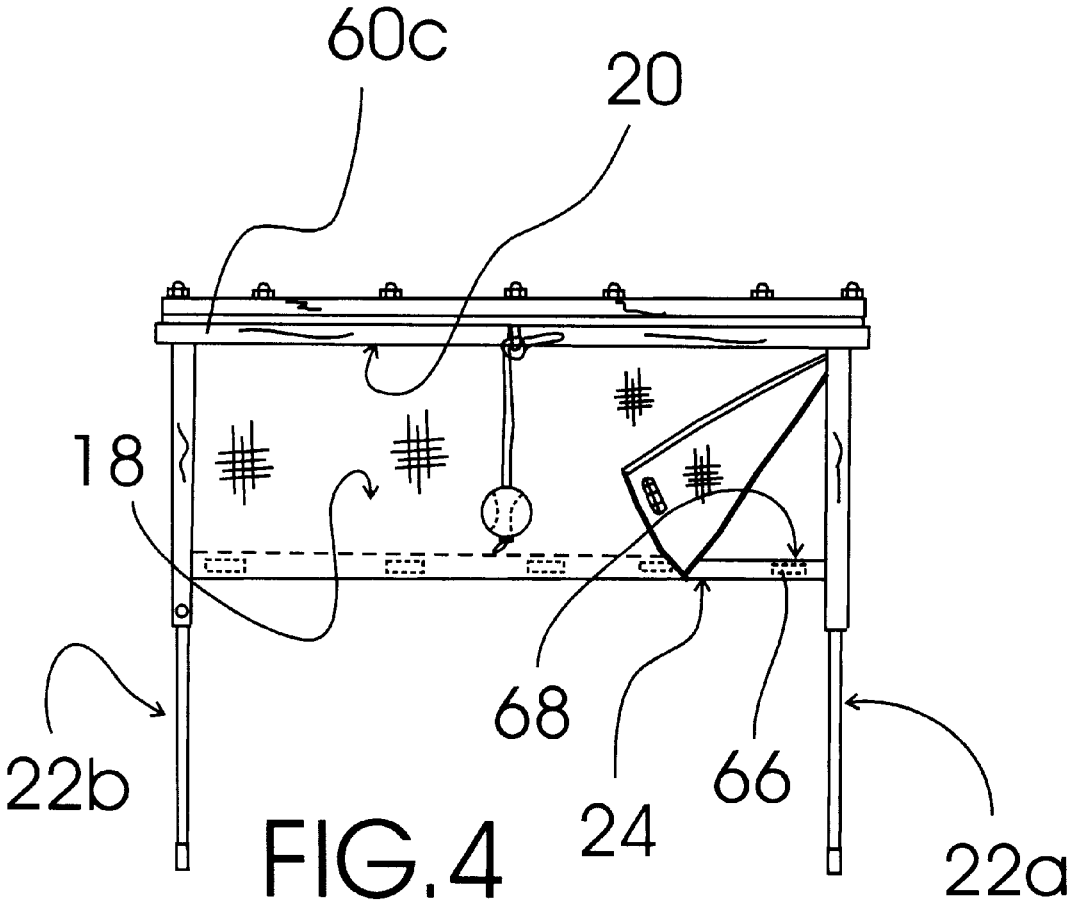
FIG. 4 is a side plan view of the portable dual batter trainer of FIG. 1 showing the removable fabric safety divider partially detached from the bottom cross brace of the collapsible support stand.
Figure 5:
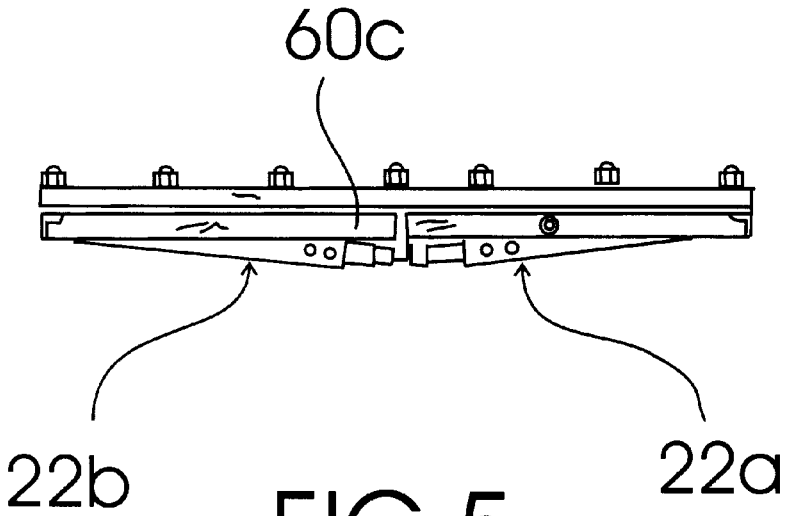
FIG. 5 is a side plan view of the portable dual batter trainer of FIG. 1 showing the two telescoping, pivoting leg assemblies pivoted against the three spaced, parallel oriented, horizontal support tubes in the closed position.

Bottom cross brace 24 has two brace ends 50,52 wherein each brace end 50,52 is insertable into and securable within one of the cross brace receiving tubes 34 by a bolt and wing nut assembly, generally designated 54. Upper horizontal support assembly 20 has three, spaced, parallel oriented, horizontal support tubes 60*a*,60*b*,60*c*. Each of the telescoping, pivoting leg assemblies 22*a*.22*b* is connected to opposite ends of the three spaced parallel oriented, horizontal support tubes 60*a*,60*b*,60*c* and are, with reference now also to FIG. 4, pivotal into an open position oriented perpendicular to three spaced, parallel oriented, horizontal support tubes 60*a*,60*b*,60*c*, and, referring now also to FIG. 5, into a closed position folded against the three spaced, parallel oriented, horizontal support tubes 60*a*,60*b*,60*c*.

Bottom cross brace 24 is connectable between the two telescoping, pivoting leg assemblies 22*a*,22*b* when the two telescoping, pivoting leg assemblies 22*a*,22*b* are both positioned in the open position.

Spaced, parallel oriented, horizontal support tube 60*b* of upper horizontal support assembly 20 and bottom cross brace 24 are each provided with tube fastening hook and pile fasteners 66 along a side thereof. Removable fabric safety divider 18 includes divider hook and pile fasteners 68 (shown in dashed lines FIG. 3) that are companionately attachable to tube fastening hook and pile fasteners 66 to detachably secure removable fabric safety divider 18 to collapsible support stand 12. In use, the user can adjust the height of each tethered batting ball 16*a*,16*b* by adjusting the length of a tether 70 or adjusting the height of trainer top plate assembly 14 by adjusting the height of telescoping pivoting leg assemblies 22*a*,22*b*. Trainer top plate assembly 14 includes a plastic plate 80 for absorbing the impact of tethered balls 16*a*,16*b* when they are struck by an athlete during use of portable dual batter trainer 10.

It can be seen from the preceding description that a portable dual batter trainer has been provided that includes a collapsible support stand, a trainer top plate assembly secured to the collapsible support stand, two tethered batting balls suspended from the trainer top plate assembly, and a removable fabric safety divider securable to the collapsible support stand between the two tethered batting balls; the collapsible support stand including an upper horizontal support assembly, two telescoping, pivoting leg assemblies and a bottom cross brace; each of the two telescoping pivoting leg assemblies including a foot portion including a floor contact tube with two spaced foot tubes extending perpendicularly from the floor contact tube and in parallel with each other and a top pivoting portion having a cross brace receiving tube secured between two foot tube receiving tubes; the two foot tube receiving tubes each having a first receiving tube end pivotally connected to the upper horizontal support assembly and a second pivoting tube end adapted to slidingly receiving one of the two foot tubes; the two foot tubes being adjustably securable in fixed relation to the two foot tube receiving tubes with a height adjustment securing bolt so as to support the trainer top plate assembly at the desired height in use; the bottom cross brace having two brace ends wherein each brace end is insertable into and securable within one of the cross brace receiving tubes by a bolt and nut assembly; the upper horizontal support assembly having three, spaced, parallel oriented, horizontal support tubes; two telescoping, pivoting leg assemblies each pivotally connected to opposite ends of the three spaced parallel oriented, horizontal support tubes of the upper horizontal support assembly and pivotal into an open position oriented perpendicular to the three spaced, parallel oriented, horizontal support tubes and into a closed position folded against the three spaced, parallel oriented, horizontal support tubes; the bottom cross brace being connectable between the two telescoping, pivoting leg assemblies when the two telescoping, pivoting leg assemblies are both positioned in the open position; the two brace ends of the bottom cross brace being each securable to a respective one of the two telescoping, pivoting leg assemblies to maintain the two telescoping, pivoting leg assemblies in the open position; one of the three, spaced, parallel oriented, horizontal support tubes of the upper horizontal support assembly and the bottom cross brace each being provided with tube fastening hook and pile fasteners along a side thereof; the removable fabric safety divider including divider hook and pile fasteners that are companionately attachable to the tube fastening hook and pile fasteners to detachably secure the removable fabric safety divider to the collapsible support stand.

It is noted that the embodiment of the portable dual batter trainer described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A portable dual batter trainer comprising:

a collapsible support stand;

a trainer top plate assembly secured to said collapsible support stand; and two tethered batting balls suspended from said trainer top plate assembly;

said collapsible support stand including an upper horizontal support assembly, two telescoping, pivoting leg assemblies and a bottom cross brace;

each of said two telescoping pivoting leg assemblies including a foot portion including a floor contact tube with two spaced foot tubes extending perpendicularly from said floor contact tube and in parallel with each other and a top pivoting portion having a cross brace receiving tube secured between two foot tube receiving tubes;

said two foot tube receiving tubes each having a first receiving tube end pivotally connected to said upper horizontal support assembly and a second pivoting tube end adapted to slidingly receiving one of said two foot tubes;

said two foot tubes being adjustably securable in fixed relation to said two foot tube receiving tubes with a height adjustment securing bolt so as to support said trainer top plate assembly at said desired height in use;

said bottom cross brace having two brace ends wherein each brace end is insertable into and securable within one of said cross brace receiving tubes by a bolt and nut assembly;

said upper horizontal support assembly having three, spaced, parallel oriented, horizontal support tubes;

two telescoping, pivoting leg assemblies each pivotally connected to opposite ends of said three spaced parallel oriented, horizontal support tubes of said upper horizontal support assembly and pivotal into an open position oriented perpendicular to said three spaced, parallel oriented, horizontal support tubes and into a closed position folded against said three spaced, parallel oriented, horizontal support tubes;

said bottom cross brace being connectable between said two telescoping, pivoting leg assemblies when said two telescoping, pivoting leg assemblies are both positioned in said open position;

said two brace ends of said bottom cross brace being each securable to a respective one of said two telescoping, pivoting leg assemblies to maintain said two telescoping, pivoting leg assemblies in said open position.

2. The portable dual batter trainer of claim 1 further comprising:

a removable fabric safety divider securable to said collapsible support stand between said two tethered batting balls, said removable fabric safety divider including divider fasteners along opposed side edges thereof;

and wherein:

one of said three, spaced, parallel oriented, horizontal support tubes of said upper horizontal support assembly and said bottom cross brace are each provided with tube fastening fasteners along a side thereof that are companionately attachable to said divider fasteners to detachably secure said removable fabric safety divider to said collapsible support stand.

* * * * *